US005540623A

United States Patent [19]

Symonds

[11] Patent Number: 5,540,623

[45] Date of Patent: Jul. 30, 1996

[54] BOWLING THUMB HOLE TAPE TOOL

[76] Inventor: Danny K. Symonds, 10618 U. S. 31, Berrien Springs, Mich. 49103

[21] Appl. No.: 389,909

[22] Filed: Feb. 16, 1995

[51] Int. Cl.[6] ..... A63B 47/00

[52] U.S. Cl. ..... 473/54; 473/130; 30/169; 30/316; 30/125; 81/490; 16/110.5

[58] Field of Search ..... 473/54, 129, 130; D8/47; 16/110.5; 132/73, 73.5, 75; 81/489, 490; 30/26, 27, 340, 167, 167.1, 168, 169, 316, 342, 113.1, 125

[56] References Cited

U.S. PATENT DOCUMENTS

| | | | |
|---|---|---|---|
| 527,240 | 10/1894 | Garies | 30/26 |
| 657,011 | 8/1900 | Schilz | 132/75.3 |
| 1,551,815 | 9/1925 | Ferguson | 30/113.1 |
| 2,640,518 | 6/1953 | Berghorn . | |
| 2,837,993 | 6/1958 | Price | 101/4 |
| 3,093,172 | 6/1963 | Reed | 81/489 |
| 3,266,804 | 8/1966 | Carter | 273/63 |
| 3,271,031 | 9/1966 | Mitchell | 273/63 |
| 3,342,488 | 9/1967 | Novatnak | 273/63 |
| 3,991,465 | 11/1976 | Cross | 30/316 |
| 4,569,520 | 2/1986 | Yamane | 273/63 |
| 4,621,461 | 11/1986 | Martin | 51/181 |
| 4,648,416 | 3/1987 | Kilman et al. | 132/73 |
| 5,261,660 | 11/1993 | Rowland | 473/130 |

OTHER PUBLICATIONS

"Starret–Wade", Fall/Winter 1978 Catalog, p. 50, D8/47.

*Primary Examiner*—V. Millin
*Assistant Examiner*—William M. Pierce
*Attorney, Agent, or Firm*—Howard & Howard

[57] ABSTRACT

An improved bowler's tape tool includes a curved tool portion with an enlarged handle portion. A knife edge is formed at one end of the curved tool portion. The knife edge is smaller than the curved tool in both radial thickness and circumferential extent. The knife edge can be placed behind the tape in a bowler's thumb hole for removal of the tape. The curved tool is utilized to apply new tape within the thumb hole. The handle facilitates easy gripping and movement of the tool to either apply or remove the tape. In other aspects of this invention, the handle portion extends radially outwardly for a greater distance then the curved tool portion. This ensures that the user is able to properly control the curved tool portion and apply the required forces for application or removal of the tape. Further, the curved tool portion is preferably formed with a radius of curvature that is smaller than the radius of curvature of the thumb hole such that the tool can be easily moved within the thumb hole. In another aspect of this invention, the handle is hollow, and a cap is threaded upon the end of the handle. The cap may be removed to provide access to the interior of the handle, which is preferably utilized to store the bowler's tape.

10 Claims, 1 Drawing Sheet

BOWLING THUMB HOLE TAPE TOOL

BACKGROUND OF THE INVENTION

This application relates to a tool for inserting or removing tape from the thumb hole of a bowling ball.

The diameter of the holes in a bowling ball must be closely matched to the size of the bowler's thumb and fingers. As a bowler becomes more skilled, the need for a close match becomes even more important. Keeping a close match is not as easy as might be expected. More skilled bowlers recognize that the size of their fingers changes seasonally. In the summer, fingers tend to be larger than in the winter. Since the size of the hole must be cut to fit the finger at its largest expected dimension, at all other times of the year the hole will be too large for a proper fit.

Several prior art patents disclose various methods of modifying the diameter of a thumb hole in a bowling ball. U.S. Pat. Nos. 3,266,804; 3,271,031; 3,342,488; 5,261,660; and 4,569,520 all disclose items to be mounted within the thumb or finger hole of the bowling ball. U.S. Pat. No. 2,640,518 and 2,837,993 both disclose tools for modifying the surface of the thumb hole.

None of these prior art devices have proven particularly successful. Instead of these proposed devices, small pieces of bowling tape have typically been placed within the thumb hole to modify the diameter of the thumb hole.

One problem with the small pieces of tape, has been in preserving the tape until it is to be used. The small pieces of tape are often crushed within the bowling bag, and thus are unusable when the bowler wants to apply them to the bowling ball thumb hole.

As will be explained below, there are also problems in properly mounting and removing the small pieces of bowling tape.

Standard bowling tape is a relatively thin piece of tape that is lined within the thumb hole of the bowling ball to reduce the effective diameter of the hole, and thus provide a close fit to the bowler's thumb. For this tape to be functional, it must have a strong adhesive to secure it properly to the bowling ball. There is a good deal of friction between the thumb and the thumb hole, and thus the tape must include the strong adhesive or it will be quickly removed from the thumb hole.

Problems arise with this tape in that the strong adhesive makes it difficult to properly attach the tape. The tape tends to stick wherever it initially contacts. It is difficult to properly place the tape within the relatively deep thumb hole without contacting the ball prior to properly placing the tape.

Bowlers have used many types of tools to apply the tape, such as scissors, small screwdrivers, knives, pencils or other elongated items that may extend into the hole. However, none of these tools have proven satisfactory, in that the tools still do not properly position the tape prior to initial contact between the tape and the ball. While one tape manufacturer has proposed small curved tools, those tools have been generally short pieces of plastic that have also not proven effective.

Another problem is the removal of old tape. Bowlers have attempted to scrape off the old tape using hand tools such as scissors, small screwdrivers, knives or pencils. These tools have not easily removed the old tape and have also damaged the bowling ball.

In general, the prior tools utilized to apply or remove tape have not provided sufficient leverage or proper placement of a tool edge relative to the thumb hole.

SUMMARY OF THE INVENTION

In the disclosed embodiment of this invention, a bowler's tape tool includes a handle portion that is connected to a tool portion. The tool portion preferably has a curved surface that receives the tape. A knife edge is formed at the end of the tool portion. The curved surface ensures that the tape is held curved such that it can be properly applied within the thumb hole in a desired orientation. In a preferred embodiment of this invention, the handle and tool portion are integrally molded from plastic. More preferably, the handle is formed to radially surround all portions of the tool portion. In this way, the handle portion allows the bowler to fully control the tool portion when applying tape, and also to apply a centered downward movement to the knife edge when removing the tape. More preferably, the curve on the tool portion has a smaller radius of curvature than the thumb hole. This ensures that the curved tool will fit within the thumb hole and that it can be moved within the thumb hole to properly apply the tape.

In other aspects of this invention, the handle is preferably hollow and safely stores the tape pieces. In the prior art, there has been some difficulty in properly storing the tape without damaging the small tape sections.

A method of applying tape includes the steps of providing a tool having an enlarged handle surrounding a curved tool portion. Tape is placed upon the curved tool portion with its adhesive surface attached to one end of the tool. The tool holds the tape in a curved orientation. The tool is then inserted within the thumb hole, and the bowler begins to apply the tape by attaching the tape to the thumb hole. When one desires to remove old tape, the tool has a knife edge at a forward end that is used in combination with the handle to scrape the tape out of the thumb hole. The knife edge is also preferably tapered and curved such that it corresponds to the shape of the thumb hole, to allow easy removal of the tape.

These and other features of the present invention can be best understood from the following specification and drawings, the following of which is a brief description.

DETAILED DESCRIPTION OF A PREFERRED EMBODIMENT

Figure 1:
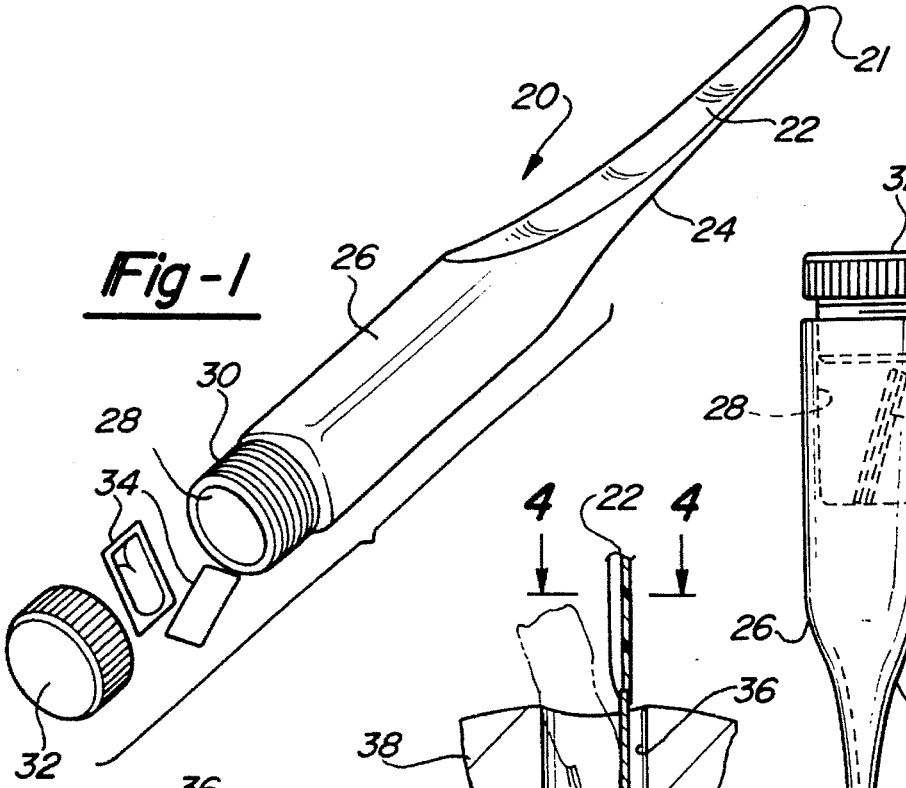
FIG. 1 is a perspective view of a bowler's tape tool.

FIG. 1 is a perspective view of a tool 20 for applying and removing tape from the thumb hole of a bowling ball. A knife edge 21, and a tool portion 22 are formed at one end, and a curved extension portion 24 extends to an enlarged handle portion 26. Handle portion 26 is formed to be securely gripped by a user. Handle portion 26 is also hollow, as shown generally at 28, and includes an end 30 having threads 31 to receive a cap 32. Pieces of tape 34 may be stored within the hollow handle 26. As such, the bowler is able to store the tape pieces in the tool, thus eliminating the prior art problem of damage to the tape pieces.

Figure 2:
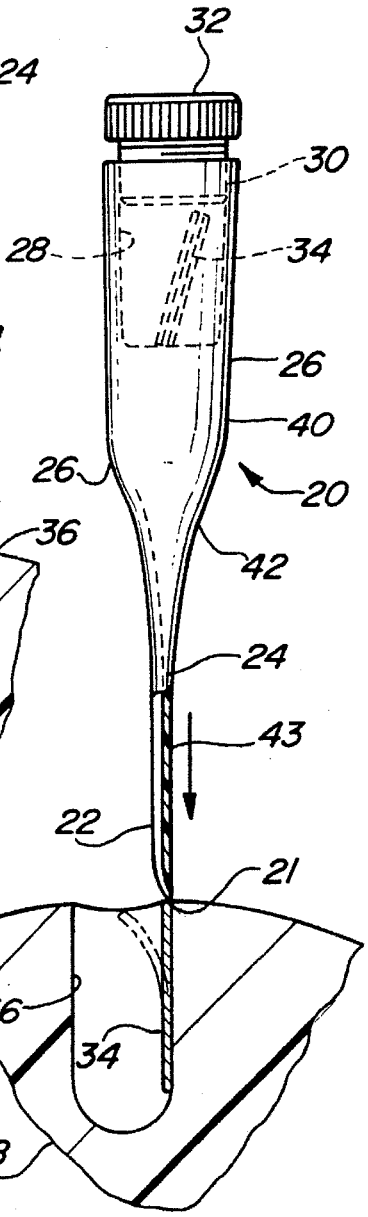
FIG. 2 is a view showing the tape within a thumb hole, and also the use of the tool as a knife edge for removing the tape.

As shown in FIG. 2, bowling tape 34 is received within the inner periphery of thumb hole 36 and bowling ball 38. The tape piece 34 reduces the diameter of the thumb hole 36, thus allowing the diameter to conform to the particular thumb thickness of the bowler at that period of the year. Although one layer of tape is shown, several layers of tape may be used, if necessary. The application of the tape with the improved tool will be described below. The use of the tool to remove tape will now be described.

As also shown in FIG. 2, when tool 20 is being utilized to remove the tape portion 34 from the thumb hole 36, the knife edge 21 is initially placed behind the tape. The bowler holds the handle portion 26 and applies a downward force scraping the tape 34 from the thumb hole 36. Since knife edge 21 has a curved surface, it is able to easily remove the tape 34 without damage to the thumb hole 36. As can also be seen, knife edge 21 is thinner than the tool portion 22. Stated geometrically, knife edge 21 is radially thinner than tool portion 22, measured from an axis of curvature of inwardly curved face 39 of tool portion 22. This facilitates the placement of knife edge 21 behind the tape to be removed.

Figure 3:
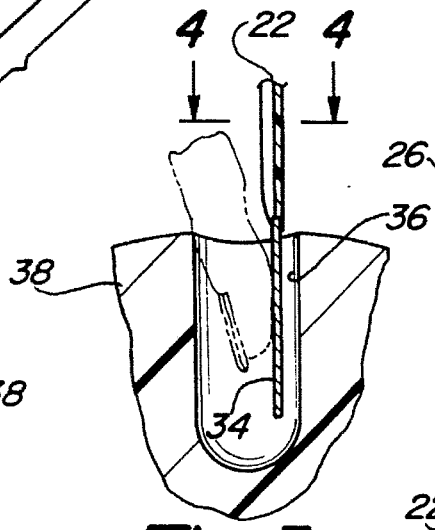
FIG. 3 shows the application of tape to the tool to begin insertion into the thumb hole.

As shown in FIG. 3, when one desires to place a portion of tape within the thumb hole 36, the tape 34 is initially placed on an inwardly curved face 39 of the curved tool portion 22 adjacent to the end. The tape portion 34 is then placed in thumb hole 36. The bowler's finger begins to smooth the tape against the interior of the thumb hole 36 on bowling ball 38. The bowler begins by placing the inner end of tape portion 34 against the mold, as shown in phantom at 40. The bowler then moves his finger outwardly, smoothing the tape along the thumb hole until only the tip remains unattached to the hole. The tape tip is easily pulled from the tool and then is also attached to the surface of the thumb hole.

The use of the curved face 39 allows the bowler to properly maintain the tape in a curved orientation as it is being placed within the thumb hole 36. The bowler may thus apply the tape slowly and carefully to the thumb hole 36 to ensure that it is properly positioned.

Figure 4:
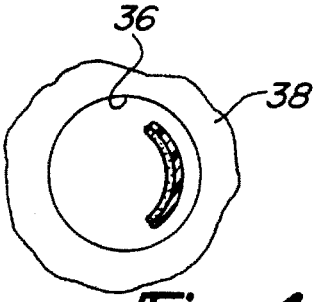
FIG. 4 shows a step in the application of the tape.

As can be best seen from FIG. 4, the radius of curvature of the tool portion 22 and in particular its face 39 is much smaller than the radius of curvature of the thumb hole 36. This facilitates easy and free movement of the tool 20 relative to the thumb hole 36 when applying the tape. A bowler is thus able to properly position the tape within the thumb hole 36.

Figure 5:
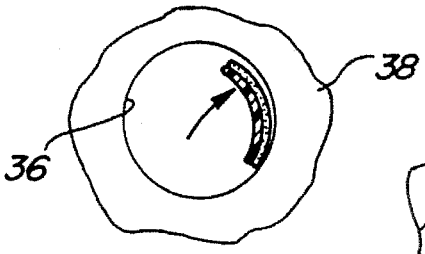
FIG. 5 shows a portion of tape received upon the curved tool end of the tool.

As shown in FIG. 4, the tape may be inserted centrally into the thumb hole. As shown in FIG. 5, the tape and tool are then brought against the thumb hole and attached as described above.

Figure 6:
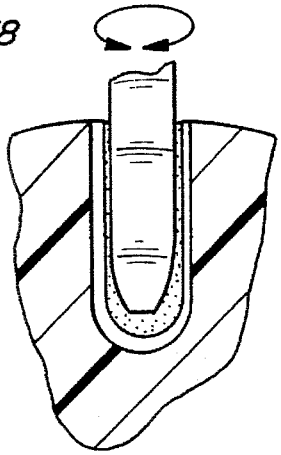
FIG. 6 shows a detail of the tool.

As shown in FIG. 6, the knife edge 21 is gently curved to a taper point. That is, knife edge 21 does not extend for as great a circumferential distance as does tool portion 22. This taper point facilitates the placement of the knife edge 21 behind the tape portion 34 for removal.

The handle 26, extension 24, tool portion 22 and knife edge 21 are all preferably integrally formed as a one piece plastic unit. The one-piece construction increases the structural stability of the tool, and allows the user to apply a greater force from handle 26 to the tool portion 22 or the knife edge 21.

In a method of utilizing this invention, a tape is initially placed at one end of the tool portion 22 at one end. The tape preferably extends axially beyond the end, and is held in a generally curved orientation by the face 39. The tool is then inserted within the thumb hole 36, and the user begins to place the tape against the thumb hole 36. As the tape contacts the thumb hole, it will become secured to the thumb hole. Eventually, the tool 22 is completely removed from the tape, which is then properly positioned within the thumb hole 36.

When a user wishes to remove the tape 34, the knife edge 21 is initially placed behind the tape 34, and a downward force is applied through handle 26. The downward motion scrapes and removes the tape portion 34 from the thumb hole 36.

A preferred embodiment of this invention has been disclosed, however a worker of ordinary skill in the art would recognize the certain modifications that come within the scope of this invention. For that reason, the following claims should be studied to determine the true scope and content of this invention.

I claim:

1. A tool in combination with at least one strip of bowling tape, said tool is for applying and removing bowling tape from a bowling ball thumb hole and having:

a curved tool portion at one axial end, said curved tool portion being adapted to receive a piece of bowling tape and facilitate the placement of that within the thumb hold, said curved tool portion being curved about an axis of curvature;

an enlarged handle portion extending radially to an outer circumference which is radially outward of said curved tool portion, and at an opposed axial end of said tool, said handle portion being operable to be gripped by a user when tape is applied to the curved tool portion to place the tape within the bowling thumb hole;

a knife edge formed at an extreme end of said curved tool portion, said knife edge being of a thinner width in a radial direction compared to said tool portion to facilitate placement of said knife edge behind a piece of tape for removal of the tape from the bowling hole; and said handle portion being hollow, and a cap received on an end of said handle portion, said cap being removable to provide access to said hollow handle portion, said hollow handle portion being large enough to store at least one strip of bowling tape, and said at least one bowling tape strip being stored in said hollow handle portion.

2. A tool as recited in claim 1, wherein said handle portion and said curved tool portion are integrally formed.

3. A tool as recited in claim 2, wherein said handle portion curves inwardly to said curved tool portion to increase the strength of the tool.

4. A tool as recited in claim 3, wherein said knife edge is also tapered circumferentially from said curved tool portion such that said knife edge extends for a smaller circumferential distance than does said curved tool portion to facilitate placement of said knife edge behind a piece of tape to be removed.

5. A tool as recited in claim 4, wherein said handle portion is hollow, and a cap is placed upon an end of said handle portion, said cap being removable to provide access to said hollow handle portion, said hollow handle portion being large enough to store pieces of tape.

6. A tool as recited in claim 1, wherein the radius of curvature of said curved tool is smaller than the radius of curvature of the bowling ball thumb hole such that said tool may be moved within the bowling ball thumb hole.

7. A tool as recited in claim 1, wherein said handle and said curved tool portion are integrally molded from plastic.

8. A tool as recited in claim 1, wherein said handle portion curves inwardly to said curved tool portion to increase the strength of the tool.

9. A tool as recited in claim 1, wherein said knife edge is tapered circumferentially from said curved tool portion such that said knife edge extends for a smaller circumferential distance than does said curved tool portion to facilitate placement of said knife edge behind a piece of tape to be removed.

10. A tool as recited in claim 1, wherein the radius of curvature of said curved tool is smaller than the radius of curvature of the bowling ball thumb hole such that said tool may be moved within the bowling ball thumb hole.

* * * * *